US008459790B2

(12) United States Patent
Hara et al.

(10) Patent No.: US 8,459,790 B2
(45) Date of Patent: Jun. 11, 2013

(54) LIQUID EJECTING APPARATUS

(75) Inventors: Keiji Hara, Minowa-machi (JP); Osamu Shinkawa, Chino (JP); Akihiko Ikegami, Okaya (JP)

(73) Assignee: Seiko Epson Corporation, Tokyo (JP)

( * ) Notice: Subject to any disclaimer, the term of this patent is extended or adjusted under 35 U.S.C. 154(b) by 90 days.

(21) Appl. No.: 13/015,477

(22) Filed: Jan. 27, 2011

(65) Prior Publication Data

US 2011/0187804 A1 Aug. 4, 2011

(30) Foreign Application Priority Data

Jan. 29, 2010 (JP) ..... 2010-018553

(51) Int. Cl.
*B41J 2/01* (2006.01)

(52) U.S. Cl.
USPC ..... 347/104; 347/101

(58) Field of Classification Search
USPC ..... 347/102, 101, 104, 29, 218, 187, 347/141, 16, 85, 40; 118/258
See application file for complete search history.

(56) References Cited

U.S. PATENT DOCUMENTS

| | | | | |
|---|---|---|---|---|
| 6,406,141 | B2 * | 6/2002 | Yosimura et al. | 347/102 |
| 6,463,674 | B1 * | 10/2002 | Meyers et al. | 34/304 |
| 7,128,389 | B2 * | 10/2006 | Okamoto et al. | 347/29 |
| 7,250,959 | B2 * | 7/2007 | Cloutier et al. | 347/187 |
| 2001/0015746 | A1 | 8/2001 | Yosimura et al. | |
| 2005/0036022 | A1 * | 2/2005 | Okamoto et al. | 347/101 |
| 2005/0088504 | A1 * | 4/2005 | Kudoh et al. | 347/104 |
| 2007/0008398 | A1 * | 1/2007 | Cloutier et al. | 347/218 |
| 2008/0136890 | A1 * | 6/2008 | Shinkawa et al. | 347/141 |
| 2009/0235863 | A1 * | 9/2009 | Takatsuka | 118/258 |
| 2010/0079545 | A1 * | 4/2010 | Shimoda et al. | 347/40 |
| 2010/0103237 | A1 | 4/2010 | Hara et al. | |
| 2010/0110156 | A1 * | 5/2010 | Hara et al. | 347/102 |
| 2010/0188455 | A1 * | 7/2010 | Shinkawa et al. | 347/16 |
| 2011/0157286 | A1 * | 6/2011 | Ikegami et al. | 347/104 |
| 2011/0205316 | A1 * | 8/2011 | Ikegami et al. | 347/85 |
| 2011/0316951 | A1 * | 12/2011 | Horikawa | 347/104 |

FOREIGN PATENT DOCUMENTS

| | | |
|---|---|---|
| JP | 07-172619 | 7/1995 |
| JP | 10-193722 | 7/1998 |
| JP | 2005-089125 | 4/2005 |
| JP | 2010-094919 | 4/2010 |
| JP | 2010-100014 | 5/2010 |
| JP | 2010-110926 | 5/2010 |
| JP | 2010-167737 | 8/2010 |

* cited by examiner

*Primary Examiner* — Manish S Shah
*Assistant Examiner* — Yaovi Ameh
(74) *Attorney, Agent, or Firm* — Workman Nydegger

(57) ABSTRACT

A printer includes a reversal transportation path which transports a paper to which ink ejected from liquid ejecting heads has adhered toward a downstream side in the transportation direction. In the printer, the reversal transportation path is formed between a pair of guiding plates having a substantially circular arc shape along the transportation direction of the paper and opening holes which blow out wind toward the reversal transportation path from a blowing unit are provided on an inner guiding plate of the pair of the guiding plates, which is positioned at the center side of the circular arc shape.

5 Claims, 7 Drawing Sheets

LIQUID EJECTING APPARATUS

The entire disclosure of Japanese Patent Application No. 2010-018553, filed Jan. 29, 2010 is expressly incorporated by reference herein

BACKGROUND

1. Technical Field

The present invention relates to a liquid ejecting apparatus, and in particular, relates to a technique of transporting a recording medium onto which liquid has been ejected.

2. Related Art

A liquid ejecting apparatus which forms (records) a predetermined image (including a character, a figure, and the like) on a recording medium as follows has been known. That is, in the liquid ejecting apparatus, liquid (for example, ink) is ejected onto a recording medium (for example, paper) or the like from a liquid ejecting head and is adhered thereto so that a predetermined image is formed. A discharge unit is normally provided on such liquid ejecting apparatus. The discharge unit discharges a recording medium to which liquid has adhered in a recording unit provided in the liquid ejecting apparatus onto a placement table or the like provided outside the liquid ejecting apparatus. Further, a transportation path is formed in such liquid ejecting apparatus. The transportation path is a path for transporting a recording medium to which liquid ejected from a liquid ejecting head in the recording unit has adhered from the recording unit to the discharge unit.

Such transportation path is provided such that a passage in the transportation path has a substantially semicircular arc shape in order not to increase a liquid ejecting apparatus in size when seen from above. That is to say, a recording medium is transported along the transportation path of which passage in the transportation direction has a circular arc shape as described above. Therefore, front and back surfaces of the recording medium are reversed on the way of the transportation, and then, the recording medium is discharged. As a result, a placement table can be arranged so as to be superimposed with the recording unit on which a liquid ejecting head is provided when seen from above. This can realize the liquid ejecting apparatus to be reduced in size when seen from above. Various liquid ejecting apparatuses including a transportation path of which passage in the transportation direction has a substantially circular arc shape in order to reduce the liquid ejecting apparatuses in size as described above have been proposed (for example, JP-A-2005-89125).

However, when a transportation path which is curved and of which passage in the transportation direction has a substantially circular arc shape (in particular, semicircular shape) (the transportation path is also referred to as "curved transportation path") is employed, there arises a following problem. That is, when a recording medium is transported, a transportation resistance is unfortunately large in such curved transportation path in comparison with a case where a linear transportation path is employed. Note that the linear transportation path is a path of which passage through which a recording medium passes is not curved or is less curved with a large curvature. For example, a recording medium in a flat state passes through the curved transportations path, a curvature of the recording medium which is curved along the transportation path is different from (normally, larger than) that of the curved transportation path. Therefore, friction is generated between a wall surface of a passage (in particular, wall surface at the center side of a circular arc) and the recording medium so as to cause increase in a transportation resistance. Further, in a case where a transportation distance from a recording unit on which a liquid ejecting head is provided to a discharge unit is short or the like, a recording medium may pass through the curved transportation path in a state where liquid adhered to the recording medium is undried. In such a case, for example, a recording medium passes through the curved transportation path in such a state that a portion of the recording medium to which undried liquid has adhered is deformed. Therefore, the recording medium makes contact with a passage wall surface so that a transportation resistance becomes large in some case.

Then, in order to address the above cases, the following technique has been proposed (for example, JP-A-10-193722). With the technique, the air flows in a direction along the transportation direction on a transportation path of a recording medium. Therefore, liquid in an undried state is dried and a recording medium is smoothly transported to a discharge unit.

However, when the air flows in the direction along the transportation direction, an effect of drying liquid in an undried state can be expected but an effect of generating a force acting on a recording medium in the direction that the recording medium is bent cannot be expected in principle. Accordingly, it is difficult to match a curving manner of a recording medium passing through a curved transportation path with that of a curved transportation path. Therefore, there remains a problem that a transportation resistance is still large.

SUMMARY

An advantage of some aspects of the invention is to provide a liquid ejecting apparatus which can smoothly transport a recording medium through a curved transportation path curved in order to reduce the entire apparatus in size.

A liquid ejecting apparatus according to an aspect of the invention by which liquid is adhered to a recording medium includes a liquid ejecting head which ejects liquid onto the recording medium, a pair of guiding plates formed into a substantially circular arc shape, a transportation path which is formed between the pair of guiding plates and transports the recording medium to which the liquid has adhered toward a downstream side in the transportation direction, an inner guiding plate of the pair of guiding plates, which is positioned at a center side of the circular arc shape, a blowing unit which feeds air into the transportation path, and a blowing port which is provided on the inner guiding plate and through which the air fed from the blowing unit is blown out.

With this configuration, a recording medium passing through a curved transportation path can be exposed to the air from an inner surface side of the curved shape. As a result, the recording medium receives the air blown out through the blowing port so that the recording medium moves while being separated from a wall surface (inner wall surface) of the inner guiding plate at the transportation path side. Note that the inner guiding plate is one of the pair of guiding plates which form the curved transportation path. Therefore, friction between the recording medium and the inner wall surface is suppressed, whereby a transportation resistance is lowered. Accordingly, the recording medium can be transported through the curved transportation path smoothly.

In the liquid ejecting apparatus according to the aspect of the invention, it is preferable that the blowing unit be provided in a space region which is formed at the center side of the circular arc shape of the inner guiding plate.

With this configuration, since the blowing unit is arranged in a space region at the center side of the circular arc shape of the inner guiding plate of both the inner and outer guiding plates which form the transportation path having a circular arc shape. Therefore, the transportation path and the blowing unit can be arranged so as to be superimposed with each other when seen from above. As a result, the liquid ejecting apparatus can be prevented from being increased in size.

In the liquid ejecting apparatus according to the aspect of the invention, it is preferable that the blowing unit blows out warm air through the blowing port by which drying of the liquid adhered to the recording medium is accelerated.

With this configuration, a recording medium receives the warm air. Therefore, drying of liquid adhered to the recording medium is accelerated.

In the liquid ejecting apparatus according to the aspect of the invention, it is preferable that a plurality of the blowing ports be provided in a direction along the transportation direction, a blowing-out direction of the air which is blown out through an uppermost-stream blowing port provided at the uppermost-stream side in the transportation direction be perpendicular to a tangent line direction of a wall surface of the inner guiding plate at the transportation path side, and an inclination of a blowing-out direction of the air which is blown out through each of downstream blowing ports provided at the downstream side with respect to the uppermost-stream blowing port in the transportation direction from a direction perpendicular to a tangent line direction of a wall surface of the inner guiding plate at the transportation path side is gradually larger toward the downstream side in the transportation direction.

With this configuration, a force of moving a recording medium in the transportation direction can be made larger toward the downstream side in the transportation direction in such a state that the recording medium receives the airs which are blown out through the blowing ports into the transportation path. Accordingly, since the recording medium is tensioned in the transportation path in the transportation direction, a possibility that torsion or sagging is caused on the recording medium passing through the transportation path is reduced. As a result, the recording medium can be moved in the transportation path in the transportation direction smoothly.

In the liquid ejecting apparatus according to the aspect of the invention, it is preferable that a plurality of the blowing ports be provided in a direction along the transportation direction, and a ratio of an opening area of the blowing port positioned at the downstream side in the transportation direction with respect to an area of a wall surface of the inner guiding plate at the transportation path side be smaller than that of the blowing port positioned at the upstream side in the transportation direction.

With this configuration, an airflow received by a recording medium in the transportation path can be made larger toward the upstream side in the transportation direction. As a result, at the upstream side on the transportation path, bending of the recording medium, which is formed because an elapsed time from adherence of liquid is shorter than that at the downstream side, can be exposed to a large amount of airflow. On the other hand, at the downstream side on the transportation path, the recording medium on which drying of ink has been accelerated and the degree of bending has been smaller than that at the upstream side can be exposed to a small amount of airflow. In such a manner, the recording medium passing through the transportation path can be exposed to an amount of airflow in accordance with the degree of bending on recording medium. Accordingly, the recording medium can be smoothly moved on the transportation path in the transportation direction.

In the liquid ejecting apparatus according to the aspect of the invention, it is preferable that the blowing unit include a plurality of flow paths in order to feed different winds to an upstream side region and a downstream side region in the transportation direction on the transportation path.

With this configuration, a recording medium can be exposed to winds having different characteristics (for example, temperature, wind speed, or the like) between the upstream side region and the downstream side region on the transportation path. As a result, wind to which the recording medium is exposed can be adjusted in accordance with a dried state of liquid adhered to the recording medium. Therefore, drying of liquid adhered to the recording medium can be appropriately accelerated.

In the liquid ejecting apparatus according to the aspect of the invention, it is preferable that the recording medium be transported such that a surface to which liquid has adhered faces the inner guiding plate side when the recording medium passes through the transportation path.

With this configuration, liquid adhered to the recording medium can be directly exposed to wind which is blown out from the wall surface at the center side of the circular arc. As a result, liquid adhered to the recording medium can be effectively dried.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment in which the invention is embodied as an ink jet printer (hereinafter, also referred to as "printer") which is one type of a liquid ejecting apparatus will be described with reference to drawings.

Figure 1:
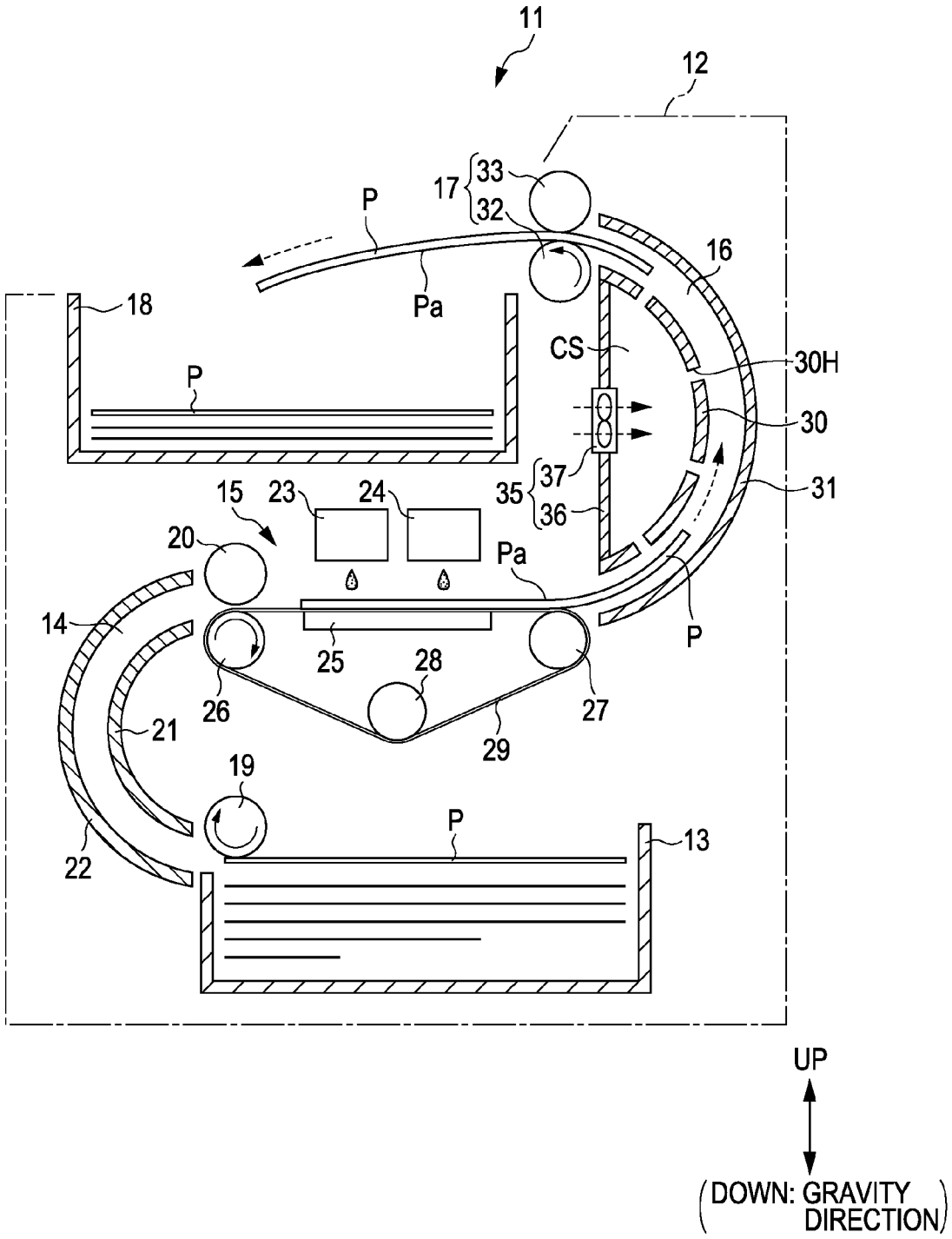
FIG. 1 is a general view illustrating a schematic configuration of a printer according to an embodiment.

As illustrated in FIG. 1, a printer 11 according to the embodiment has a casing 12 having a substantially box shape. A paper feeding tray 13 is arranged at a lower portion in the casing 12. Papers P as recording media are stored on the paper feeding tray 13 in a stacked state. A recording unit 15 is arranged at a position above the paper feeding tray 13. The recording unit 15 performs recording by making ink as liquid adhered to the recording target surface Pa of a paper P fed from the paper feeding tray 13 through a reversal paper feeding path 14. Further, a discharge unit 17 is arranged at a position above the recording unit 15 in the casing 12. The discharge unit 17 discharges the paper P, which has been transported toward a downstream side in the transportation direction (direction shown by a dashed-line arrow in FIG. 1)

from the recording unit 15 through a reversal transportation path 16, to the outside of the casing 12. Further, a placement table 18 is provided so as to be exposed to the outside of the casing 12 at a position where the placement table 18 is superimposed with the reversal paper feeding path 14 and the recording unit 15 provided in the casing 12 in the vertical direction. The placement table 18 is a member on which papers P discharged to the outside of the casing 12 through the discharge unit 17 are placed in a stacked manner.

As illustrated in FIG. 1, a paper feeding roller 19 is arranged at a position serving as a paper feeding port (at a upper left portion in FIG. 1) on the paper feeding tray 13. The paper feeding roller 19 is arranged so as to be in contact with a surface of the paper P (to be more specific, an uppermost paper) stored in the paper feeding tray 13. The paper feeding roller 19 rotates by a driving force of a motor (not shown). Further, a transportation roller 20 is provided on the recording unit 15 which is arranged above the paper feeding tray 13. To be more specific, the transportation roller 20 is provided at a position corresponding to the paper feeding roller 19, which is arranged on the paper feeding tray 13 under the recording unit 15, in the vertical direction. Further, an inner paper feeding guide 21 and an outer paper feeding guide 22 are arranged between the paper feeding roller 19 at the lower side and the transportation roller 20 at the upper side. The inner paper feeding guide 21 and the outer paper feeding guide 22 form the above reversal paper feeding path 14 between both the paper feeding guides 21, 22. Note that the paper feeding guides 21, 22 have cross sections of a semicircular arc shape. Further, when the paper feeding roller 19 rotates in the paper feeding direction (clockwise direction in FIG. 1), papers P are fed out from the paper feeding tray 13 to the recording unit 15 at the downstream side in the transportation direction one by one. At this time, the papers P are fed to the recording unit 15 through the reversal paper feeding path 14 provided between both the paper feeding guides 21, 22.

On the other hand, liquid ejecting heads 23, 24 capable of ejecting ink as liquid are arranged on the recording unit 15 so as to be paired at forward and backward sides in the transportation direction of the paper P. Further, a platen 25 which functions as a supporting table of the paper P is arranged at a position under the liquid ejecting heads 23, 24. The platen is arranged so as to be opposed to a nozzle formation surface formed on lower surfaces of the liquid ejecting heads 23, 24. It is to be noted that a large number of suction ports (not shown) are formed on an upper surface of the platen 25, which serves as a supporting surface. In addition, suction fans which perform suction operations through the suction ports are arranged inside the suction ports.

Further, a driving roller 26 is provided on the recording unit 15 at an upstream side with respect to the platen 25 in the transportation direction of the paper P. At the same time, the driving roller 26 is provided at a position opposed to the transportation roller 20 in the vertical direction. Further, a driven roller 27 is provided at a downstream side with respect to the platen 25. In addition, a tension roller 28 is arranged at a position just under the platen 25 so as to be movable in the vertical direction on an axial line. An endless belt 29 is wound over these rollers 26 to 28 such that the endless belt 29 moves around while sliding on an upper surface of the platen 25 when the driving roller 26 rotates. It is to be noted that a large number of suction holes corresponding to the suction ports on the platen 25 are formed on the belt 29. Therefore, in a case where the belt 29 moves around in a state where the suction fans are suction-driven when the driving roller 26 rotates, the paper P placed on the belt 29 is transported toward the downstream side in the transportation direction while being sucked onto the belt 29.

As illustrated in FIG. 1, in the embodiment, ink droplets are ejected from the liquid ejecting heads 23, 24 in the gravity direction (downward direction in FIG. 1). Accordingly, ink droplets are ejected onto the paper P from the liquid ejecting heads 23, 24 at positions above the platen 25 while the paper P is sucked onto the belt 29 and transported toward the downstream side on the recording unit 15. Then, an image is formed by ink adhered to the recording target surface Pa (upper surface, that is, a surface in a direction opposite to the gravity direction in FIG. 1) of the paper P.

It is to be noted that the liquid ejecting heads 23, 24 are not limited to line heads and may be configured as scanning heads provided on a carriage which moves in the width direction. Further, more line head(s) may be provided in addition to two line heads (liquid ejecting heads 23, 24) or only one line head (one of the liquid ejecting heads 23, 24) may be provided alternatively.

As illustrated in FIG. 1, an inner guiding plate 30 and an outer guiding plate 31 are arranged between a downstream edge of the recording unit 15 and the above discharge unit 17. The inner guiding plate 30 and the outer guiding plate 31 form the above reversal transportation path 16 between both the guiding plates 30, 31. Note that the guiding plates 30, 31 have cross sections of a circular arc shape along the transportation direction. A paper P to which ink has adhered on the recording target surface Pa in the recording unit 15 while being sucked onto the belt 29 which is moving around is fed out from the recording unit 15 to the discharge unit 17 provided at the downstream side in the transportation direction. To be more specific, the paper P is fed to the discharge unit 17 through the curved reversal transportation path 16 between both the guiding plates 30, 31. Accordingly, front and back surfaces of the paper P are reversed if the paper P passes through the reversal transportation path 16. Therefore, the recording target surface Pa to which ink for forming an image has adhered faces the downward direction, that is, the gravity direction in FIG. 1. In this point, the reversal transportation path 16 functions as a reversing unit which reverses front and back surfaces of the paper P.

On the other hand, the discharge unit 17 is constituted by a pair of a sheet discharge driving roller 32 and a sheet discharge driven roller 33 which can nip the paper P. The discharge unit 17 is provided at a position corresponding to the downstream edge of the reversal transportation path 16. That is to say, the paper P discharged toward the placement table 18 exposed to the upper surface side of the casing 12 from the downstream edge of the reversal transportation path 16 is discharged to the outside of the casing 12 by passing through the discharge unit 17 toward the discharge direction which is at the side of the placement table 18. To be more specific, the paper P passes through the discharge unit 17 while being nipped by the sheet discharge driving roller 32 and the sheet discharge driven roller 33 from both sides of the front and back surfaces of the paper P. Then, the discharged paper P moves (falls) in the gravity direction and is stacked and accumulated on papers P which have been previously discharged. Accordingly, in the embodiment, a surface of the paper P which faces the direction to which the paper P moves so as to be stacked on the placement table 18 corresponds to the recording target surface Pa to which ink has adhered.

It is to be noted that the front end portion of the paper P passing through the reversal transportation path 16 is nipped by the sheet discharge driving roller 32 and the sheet discharge driven roller 33 before transportation of the paper P by the belt 29 is finished, and then, is fed in the transportation direction. In other words, the length of the reversal transportation path 16 is made shorter than that of the paper P in the transportation direction such that the paper P does not stop in the reversal transportation path 16. As a result, it is configured that the paper P is reliably transferred from the transportation by the belt 29 to the transportation by the discharge unit 17.

In the printer 11 according to the embodiment, at least one opening hole 30H (a plurality of opening holes 30H in the embodiment) is provided at a wall surface of the inner guiding plate 30 which forms the reversal transportation path 16. Further, the printer 11 includes a blowing unit 35 which feeds the air into the reversal transportation path 16 through the opening holes 30H. In the embodiment, the blowing unit 35 is constituted by a shielding plate 36 which shields the air and a blowing fan 37 which is attached to a portion of the shielding plate 36. The shielding plate 36 is arranged in a region occupied by the inner guiding plate 30, that is, in a space region at the center side of the circular arc shape of the inner guiding plate 30. A closed space CS is formed between the shielding plate 36 and the inner guiding plate 30 if the opening holes 30H and the blowing fan 37 are excluded. The blowing unit 35 is configured as follows. That is, the blowing fan 37 is rotationally driven by a motor (not shown) so that gas (air in the embodiment) is fed to the formed closed space CS from the outside. Then, the air is brown out through the opening holes 30H. Accordingly, the closed space CS functions as a flow path of air and the opening holes 30H function as blowing ports.

Further, in the embodiment, the air fed into the closed space CS from the outside by the blowing fan 37 is heated to an appropriate predetermined temperature (for example, 20° C. through 50° C.) by a heater (not shown) in order to accelerate drying of ink. Accordingly, the air blown out through the opening holes 30H is warm air.

Figure 2A:
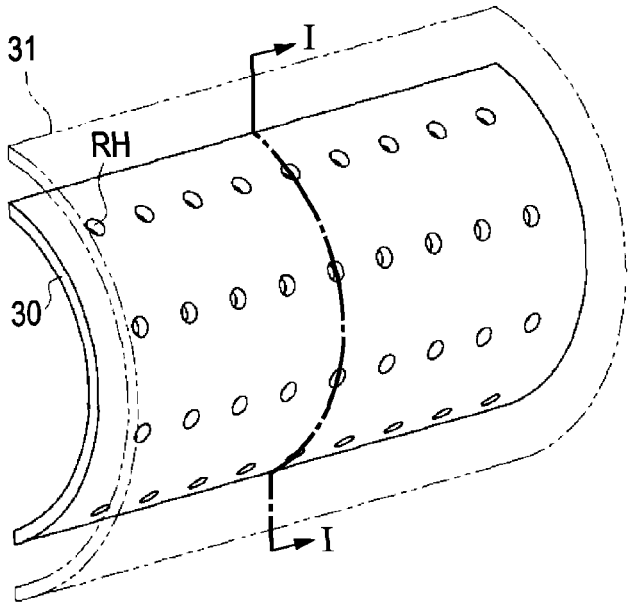
FIGS. 2A through 2C are perspective views illustrating an inner guiding plate on which blowing ports are formed.

An example of the opening holes 30H provided on a wall surface of the inner guiding plate 30 forming the reversal transportation path 16 in the embodiment is described with reference to FIGS. 2A through 2C. FIG. 2A illustrates the opening holes 30H provided on the inner guiding plate 30 in the embodiment. Each opening hole 30H is a circular hole RH having a circular hole shape. The plurality of circular holes RH is arranged at an equal interval in the transportation direction and a direction intersecting with the transportation direction. It is to be noted that as the inner guiding plate 30 in FIG. 1, a cross section cut along a line I-I in FIG. 2A, that is, a cross-section in the transportation direction is illustrated.

Figure 2B:
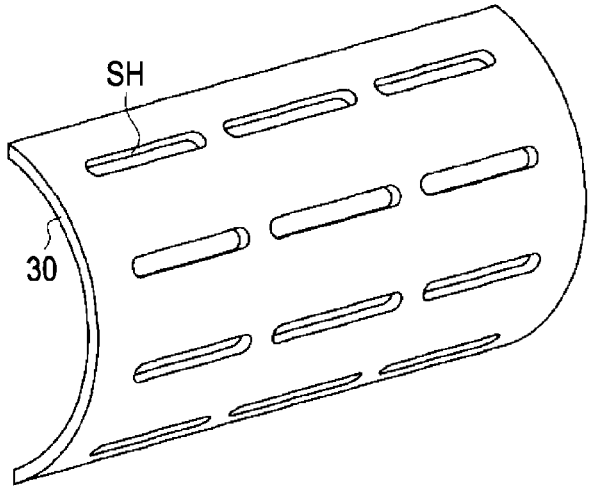
Figure 2C:
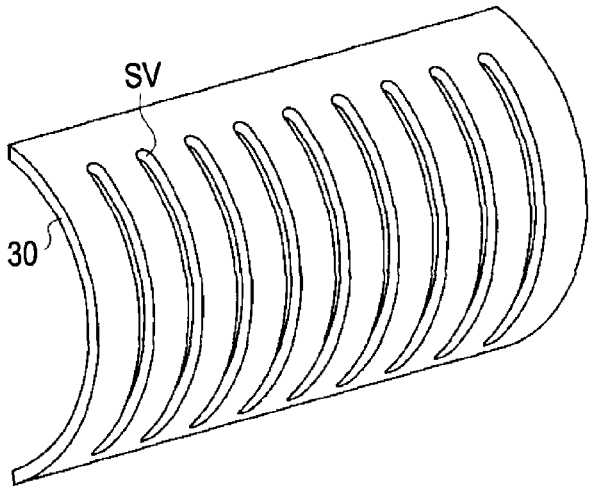

Alternatively, as another example, each opening hole 30H can be a slit hole SH having a rectangular hole shape (slit shape) as illustrated in FIG. 2B. In this case, the longitudinal direction thereof corresponds to a direction intersecting with the transportation direction and a plurality of rows of slit holes SH is arranged at an equal interval in the transportation direction. In addition, as still another example, each opening hole 30H can be a slit hole SV having a rectangular hole shape (slit shape) as illustrated in FIG. 2C. In this case, the longitudinal direction thereof corresponds to the transportation direction and a plurality of slit holes SV is arranged at an equal interval in the direction intersecting with the transportation direction.

Then, operations of the printer 11 configured in the above manner are described with focusing on operations in a case where the paper P passes through the reversal transportation path 16, in particular. Referring now to FIG. 3, it is to be noted that in order to make the description of the actions understood easily, a problem caused when the the paper P passes through the reversal transportation path 16 in the existing printer in which the opening holes 30H functioning as blowing ports are not provided on the inner guiding plate 30 is simply described.

Figure 3A:
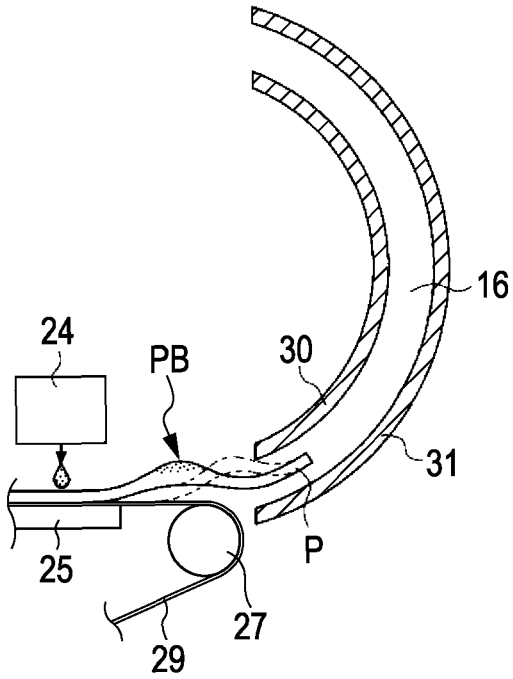
FIGS. 3A and 3B are descriptive views for explaining the movement of a paper on a transportation path when a blowing port is not formed on the inner guiding plate.

In general, it has been known that if ink ejected from the liquid ejecting heads 23, 24 is adhered to the paper P, the adhered ink is soaked into the paper P to cause a phenomenon (swelling) that the paper P swells. Accordingly, as illustrated in FIG. 3A, for example, a portion to which ink is ejected from the liquid ejecting head 24 is swelled on the paper P to be fed to the reversal transportation path 16 by the belt 29 so that a bulged portion PB in a convex form is generated on a surface of the paper P. If the bulged portion PB is generated, when the paper P is transported to the reversal transportation path 16, the bulged portion PB engages with the inner guiding plate 30 or makes contact with a wall surface of the inner guiding plate 30 as illustrated by a dashed line in FIG. 3A. As a result, there arises a problem that the paper P cannot pass through the reversal transportation path 16 smoothly.

Further, as described above, the length of the reversal transportation path 16 is shorter than that of the paper P in the transportation direction. Therefore, the paper P passes through the reversal transportation path 16 in a state where ink adhered to the paper P is not sufficiently dried in some case. This causes the following problem. That is, the undried ink is in friction against a wall surface of the inner guiding plate 30 so that a recorded image is impaired. At the same time, the undried ink makes contact with the wall surface of the inner guiding plate 30 so that a transportation resistance becomes large.

Figure 3B:
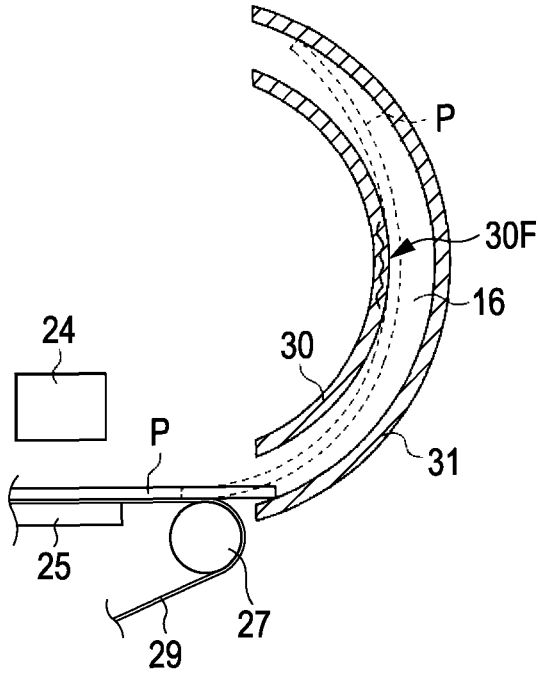

Further, there is a problem that even in a case where ink is not ejected from the liquid ejecting head 24 and the swelling phenomenon due to adherence of ink is not caused on a surface of the paper P, the paper P cannot pass through the reversal transportation path 16 smoothly. As illustrated in FIG. 3B, when the paper P passes through the reversal transportation path 16, the paper P is bent from a flat state. Therefore, as illustrated by dashed lines in FIG. 3B, the paper P is bent with a curvature larger than that of the curved inner guiding plate 30 (or the outer guiding plate 31). Therefore, a substantially center portion of the paper P in the transportation direction is in friction against a portion of the wall surface 30F of the inner guiding plate 30 as illustrated by a wavy line in FIG. 3B, for example. As a result, there also arises a problem that a transportation resistance of the paper P on the reversal transportation path 16 becomes large so that the paper P cannot pass through the reversal transportation path 16 smoothly.

Unlike the existing printer having such problems, in the printer 11 according to the embodiment, the paper P is transported on the curved reversal transportation path 16 in the following manner.

Figure 4:
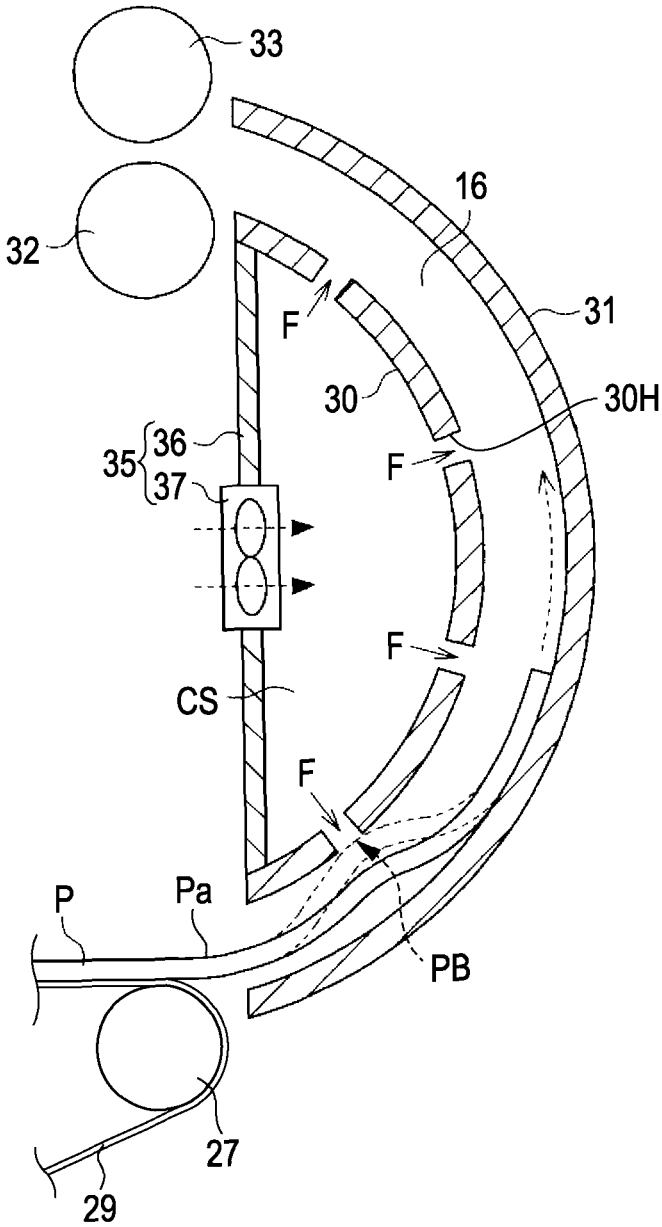
FIG. 4 is a descriptive view for explaining the movement of a paper on a transportation path according to an embodiment.

As illustrated in FIG. 4, in the embodiment, the paper P after transported by the belt 29 is inserted into the reversal transportation path 16, that is, a space between the inner guiding plate 30 and the outer guiding plate 31. At this time, as illustrated in FIG. 4, the blowing unit 35 starts to rotate the blowing fan 37 so as to feed the air into the closed space CS. The fed air is blown out through each of the opening holes 30H provided on the inner guiding plate 30 as wind F. As a result of that, the paper P moves in the reversal transportation path 16 in the transportation direction (shown by a dashed-line arrow in FIG. 4) while receiving the winds F on the recording target surface Pa at an inner surface side of the bending of the paper P until the paper P is discharged by the sheet discharge driving roller 32 and the sheet discharge driven roller 33.

Then, drying of ink on the bulged portion PB (shape shown by a dashed line) is accelerated on the reversal transportation path 16 with the wind F blown out through each of the opening holes 30H as illustrated in FIG. 4. As described above, the bulged portion PB is formed because a surface of the paper P is swelled with undried ink adhered to the recording target surface Pa and is bulged in a convex form. As a result, since drying of ink on the bulged portion PB is accelerated while the paper P moves in the reversal transportation path 16, a degree of the bulging in a convex form is lowered. Note that the wind F acts to suppress the degree of the bulging on the bulged portion PB to be lower with wind pressure thereof.

According to the above-described embodiment, the following effects can be obtained.

1. Since an inner surface side of bending of the paper P passing through the reversal transportation path 16 is exposed to wind, the inner surface side of the paper P is separated from a wall surface of the inner guiding plate 30 due to wind F. Therefore, friction between the paper P and the wall surface is suppressed, whereby a transportation resistance is lowered. As a result, the paper P can pass through the reversal transportation path 16 smoothly.

2. Since the blowing unit 35 is arranged in a space region occupied by the inner guiding plate 30 forming the reversal transportation path 16, the reversal transportation path 16 and the blowing unit 35 can be arranged so as to be superimposed with each other when seen from above. Accordingly, a region for providing the blowing unit 35 is not required to be ensured separately, whereby the printer 11 is prevented from being increased in size. As a result, the paper P can pass through the reversal transportation path 16 smoothly while suppressing a volume of the printer 11 from being large.

3. Since the blowing unit 35 feeds warm air for accelerating drying of ink adhered to the paper P, the paper P receives the warm air. Therefore, drying of the ink adhered to the paper P is accelerated.

4. A paper P is transported such that a surface of the paper P to which ink has adhered faces the center side of a circular arc when the paper P passes through the reversal transportation path 16. Therefore, the ink adhered to the paper P is directly exposed to the air blown out through the opening holes 30H provided on a wall surface of the inner guiding plate 30 at the center side of the circular arc. As a result, ink adhered to the paper P can be effectively dried.

It is to be noted that the above-described embodiment may be modified to other embodiments which will be described below. Hereinafter, other embodiments are described with modifications.

First Modification

In the above embodiment, a blowing-out direction of wind which is blown out through each of the opening holes 30H provided on the inner guiding plate 30 may be varied. For example, a blowing-out direction of wind which is blown out through the opening hole 30H provided at the uppermost-stream side in the transportation direction on the reversal transportation path 16 is set to be a direction perpendicular to a tangent line direction of a wall surface (hereinafter, referred to as "inner wall surface") of the inner guiding plate 30 at the reversal transportation path 16 side. Further, blowing-out directions of winds which are blown out through the opening holes 30H provided at the downstream side in the transportation direction may be set as follows. That is, as an opening hole 30H is nearer the downstream side, an inclination of the blowing-out direction from a direction perpendicular to a tangent line direction of the inner wall surface of the inner guiding plate 30 may be set to be larger.

Figure 5:
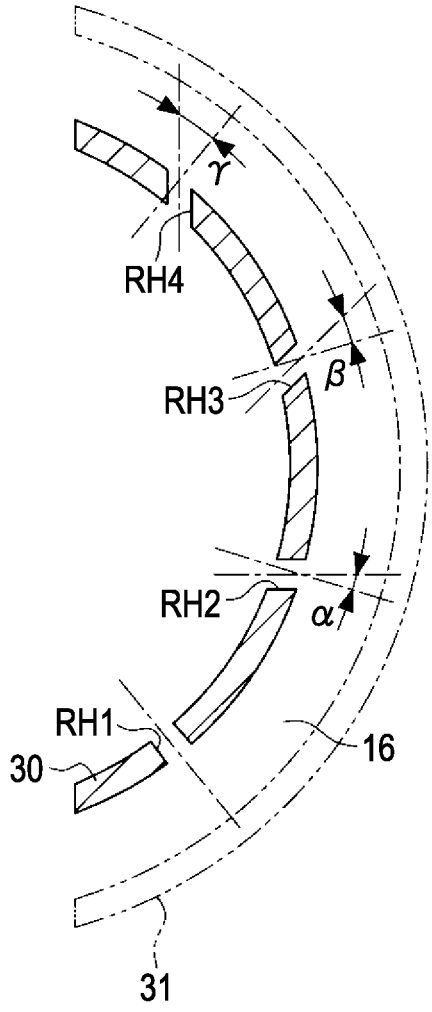
FIG. 5 is a cross-sectional view illustrating a configuration of a transportation path according to a first modification.

The modification is described with reference to FIG. 5. FIG. 5 is a cross-sectional view illustrating a cross-sectional shape of the inner guiding plate 30 forming the reversal transportation path 16 along the transportation direction. It is to be noted that since other components are the same as those in the above embodiment, these components are not illustrated in FIG. 5 and only the inner guiding plate 30 is described in the modification.

As illustrated in FIG. 5, four opening holes RH1, RH2, RH3, RH4 each having a circular hole shape are provided on the inner guiding plate 30 in the transportation direction. The opening hole RH1 which is provided at the uppermost-stream side in the transportation direction is formed as follows. That is, an axial direction of the opening hole RH1 is set to be perpendicular to a tangent line direction of an inner wall surface of the inner guiding plate 30. Further, the opening hole RH2 which is provided at the downstream side with respect to the opening hole RH1 in the transportation direction is formed as follows. That is, an inclination of an axial direction of the opening hole RH2 from a direction perpendicular to a tangent line direction of an inner wall surface of the inner guiding plate 30 is set to be a degree. Similarly, the opening hole RH3 which is provided at the downstream side with respect to the opening hole RH2 in the transportation direction is formed as follows. That is, an inclination of an axial direction of the opening hole RH3 from a direction perpendicular to a tangent line direction of an inner wall surface of the inner guiding plate 30 is set to be $\beta$ degree ($>\alpha$ degree). Further, the opening hole RH4 which is provided at the downstream side with respect to the opening hole RH3, that is, at the downmost-stream side in the transportation direction is formed as follows. That is, an inclination of an axial direction of the opening hole RH4 from a direction perpendicular to a tangent line direction of an inner wall surface of the inner guiding plate 30 is set to be $\gamma$ degree ($>\beta$ degree).

The opening holes RH1 through RH4 which function as blowing ports are formed in such a manner. With this, as an opening hole is nearer the opening hole RH4 positioned at the downmost-stream side while the opening hole RH1 is positioned at the uppermost-stream side, the blowing-out direction of wind which is blown out therethrough is closer to the transportation direction. That is, if the paper P passing through the reversal transportation path 16 receives wind which is blown out through each of the opening holes RH1, RH2, RH3, RH4, a force of moving the paper P in the transportation direction becomes larger toward the downstream side in the transportation direction.

According to the above-described first modification, the following effect can be obtained.

5. Since the paper P is tensioned in the reversal transportation path 16 in the transportation direction, a possibility that torsion or sagging is caused on the paper P passing through the reversal transportation path 16 is reduced. As a result, the paper P can be moved in the transportation direction smoothly and pass through the reversal transportation path 16.

Second Modification

In the above embodiment, the opening holes 30H are provided on the inner guiding plate 30 at an equal interval. However, the opening holes 30H may not be necessarily provided at an equal interval. For example, the opening holes 30H may be provided as follows. That is, as an opening hole 30H is nearer the downstream side from the upstream side in the transportation direction, an opening area ratio of the opening hole with respect to an area of an inner wall surface of the inner guiding plate 30 becomes smaller.

Figure 6:
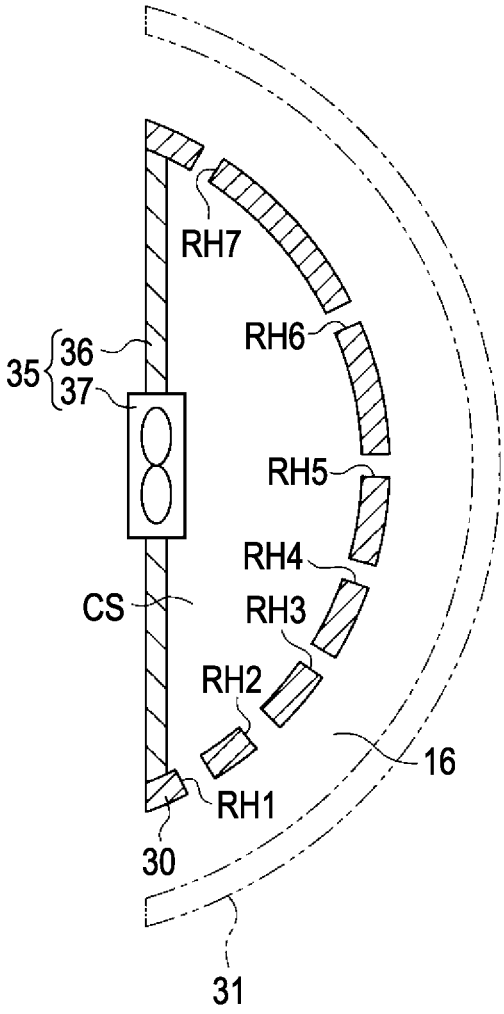
FIG. 6 is a cross-sectional view illustrating a configuration of a transportation path according to a second modification.

The modification is described with reference to FIG. 6. FIG. 6 is a cross-sectional view illustrating cross sections of only the inner guiding plate 30 which forms the reversal transportation path 16 and the blowing unit 35. It is to be noted that since other components are the same as those in the above embodiment, these components are not illustrated in FIG. 6.

As illustrated in FIG. 6, seven opening holes RH1 through RH7 each having a circular hole shape are provided on the inner guiding plate 30 in the transportation direction. The opening holes RH1 through RH7 may be provided as follows. That is, as an opening hole is nearer the downstream side from the upstream side on the reversal transportation path 16 in the transportation direction, an opening area ratio of the opening hole with respect to an area of the inner wall surface of the inner guiding plate 30 positioned at the center side of the circular arc becomes smaller. It is to be noted that in the modification, each of the opening holes RH1 through RH7 has the same hole area. Accordingly, in the modification, the opening holes RH1 through RH7 are formed such that as an opening hole is nearer the downstream side from the upstream side in the transportation direction, a ratio of the number of opening holes with respect to an area of the inner wall surface of the inner guiding plate 30 becomes smaller (for example, a distance between the opening holes is gradually larger).

An amount of airflow received by the paper P can be made larger toward the upstream side in the transportation direction by forming the opening holes RH1 through RH7 in such a manner. As a result, at the upstream side on the reversal transportation path 16, since an elapsed time from adherence of ink is short, the paper P having the bulged portion PB at which the degree of the bulging is larger in comparison with that at the downstream side can be exposed to a large amount of airflow. On the other hand, at the downstream side on the reversal transportation path 16, the paper P having the bulged portion PB at which drying of ink has been accelerated and the degree of the bulging has been smaller than that at the upstream side can be exposed to a small amount of airflow.

According to the above-described second modification, the following effect can be obtained.

6. Since the paper P passing through the reversal transportation path 16 can be exposed to an amount of airflow in accordance with the degree of bulging (bending) on the paper P, the paper P can be moved on the reversal transportation path 16 in the transportation direction smoothly.

It is to be noted that particularly in the modification, it is preferable that the air fed from the blowing unit 35 to the closed space CS be blown out through each of the opening holes RH1 through RH7 as a uniform amount of airflow. Accordingly, in FIG. 6, a state in which one blowing fan 37 is attached to the shielding plate 36 at a substantially center position of the closed space CS is illustrated. However, in fact, a plurality of blowing fans 37 is attached at appropriate positions such that an amount of airflow blown out through each of the opening holes RH1 through RH7 is uniform. Note that the blowing unit 35 may include a plurality of blowing fans 37 in such a manner not only in the modification but also in the above-described embodiment.

Third Modification

In the above embodiment, the blowing unit 35 may include at least two flow paths (closed spaces) such that flow paths of air to be fed are different between the upstream side and the downstream side in the transportation direction on the reversal transportation path 16.

Figure 7:
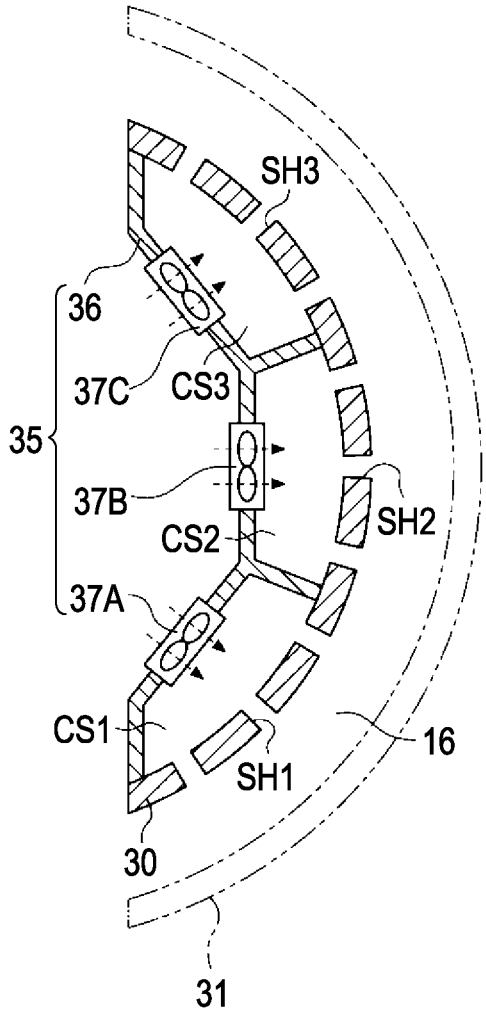
FIG. 7 is a cross-sectional view illustrating a configuration of a transportation path according to a third modification.

The modification is described with reference to FIG. 7. FIG. 7 is a cross-sectional view illustrating shapes of the inner guiding plate 30 which forms the reversal transportation path 16 and the blowing unit 35. It is to be noted that since other components are the same as those in the above embodiment, these components are not illustrated in FIG. 7.

As illustrated in FIG. 7, the blowing unit 35 according to the modification forms three closed spaces CS1, CS2, CS3 by the inner guiding plate 30 and the shielding plate 36. The three closed spaces CS1, CS2, CS3 are independent of one another. Further, blowing fans 37A, 37B, 37C are attached to the shielding plate 36 so as to feed the air into each of the three closed spaces CS1, CS2, CS3. Accordingly, the closed spaces CS1, CS2, CS3 form different flow paths through which the air fed by each of the blowing fans 37A, 37B, 37C flows. Further, the same number (three in FIG. 7) of opening holes SH1, SH2, SH3 are provided on the inner guiding plate 30 so as to correspond to each of the closed spaces CS1, CS2, CS3.

The blowing unit 35 includes three different flow paths in such a manner. Therefore, characteristics of winds blown out through the opening holes SH1, SH2, SH3 can be made different from one another by making characteristics of the airs fed by the blowing fans 37A, 37B, 37C different from one another. For example, the paper P can be exposed to winds having different wind speeds between the upstream side region and the downstream side region on the reversal transportation path 16 by controlling each of revolutions of the blowing fans 37A, 37B, and 37C. Alternatively, the paper P can be exposed to winds having different temperatures between the upstream side region and the downstream side region on the reversal transportation path 16 by controlling each of temperatures of the airs fed by the blowing fans 37A, 37B, and 37C.

According to the above-described third modification, the following effect can be obtained.

7. Wind to which the paper P is exposed can be adjusted in accordance with a dried state of ink adhered to the paper P and a bent degree of the paper P on the reversal transportation path 16. Therefore, drying of ink adhered to the paper P can be appropriately accelerated. Accordingly, the paper P can be moved in the transportation direction smoothly.

Other Modifications

The above modifications may be arbitrarily combined and executed. For example, by combining the above first modification and the above third modification, a blowing-out direction of wind through the opening hole SH2 may be inclined in the transportation direction and a blowing-out direction of wind through the opening hole SH3 may be further inclined in the transportation direction with respect to the blowing-out direction of wind through the opening hole SH1. In the same manner, although descriptions are omitted, the first modification may be combined with the second modification and the second modification may be combined with the third modification. Alternatively, all of the above modifications may be combined. By combining the modifications as described above, drying of ink adhered to a paper, P can be appropriately accelerated, and it is expected that the paper P can be moved in the transportation direction smoothly.

In the above embodiment, a liquid ejecting apparatus is embodied as the ink jet printer 11. However, liquid ejecting apparatuses which eject and discharge liquids other than ink may be employed. The invention can be applied to various types of liquid ejecting apparatuses including a liquid ejecting head or the like which discharges a trace amount of liquid droplets. Note that the terminology "liquid droplets" represents the state of liquid which is discharged from the above liquid ejecting apparatus. For example, a granule form, a teardrop form, and a form that pulls tails in a string-like form therebehind are included as the liquid droplets. The terminology "liquid" here represents materials which can be ejected by the liquid ejecting apparatus. For example, any materials are included as long as the materials are in a liquid phase. For example, materials in a liquid state having high viscosity or low viscosity or a fluid state such as a sol, gel water, other inorganic solvents, an organic solvent, a solution, a liquid resin or a liquid metal (molten metal) can be included as the liquid. Further, the liquid is not limited to liquid as one state of a material but includes a solution, a dispersion or a mixture of particles of a functional material made of a solid material such as pigment particles or metal particles. Typical examples of the liquid are ink described in the above embodiment and liquid crystals. The terminology "ink" here encompasses various liquid compositions such as common aqueous ink and oil ink, gel ink and hot melt ink. Specific examples of the liquid ejecting apparatus include a liquid ejecting apparatus which ejects liquid in forms of a dispersion or a solution of a material such as an electrode material or a coloring material. The material such as the electrode material or the coloring material are used for manufacturing liquid crystal displays, electroluminescence (EL) displays, surface emitting displays and color filters, for example. Further, the specific examples of the liquid ejecting apparatus include a liquid ejecting apparatus which ejects a bioorganic material used for manufacturing biochips, a liquid ejecting apparatus which ejects liquid used as a precision pipette and serving as a sample, a printing equipment and a micro dispenser. Other examples of the liquid ejecting apparatus include a liquid ejecting apparatus which pinpoint ejects lubricating oil to a precision machine such as a watch or a camera. Further, a liquid ejecting apparatus which ejects a transparent resin solution of an ultraviolet curable resin or the like onto a substrate in order to form a hemispherical microlens (optical lens) used for an optical communication element and the like is included as the liquid ejecting apparatus. In addition, a liquid ejecting apparatus which ejects an acid or alkali etching solution for etching a substrate or the like may be employed as the liquid ejecting apparatus. The invention can be applied to any one type of the liquid ejecting apparatuses.

What is claimed is:

1. A liquid ejecting apparatus by which liquid is adhered to a recording medium comprising:

a liquid ejecting head which ejects liquid onto the recording medium;

a pair of guiding plates formed into a substantially circular arc shape, the pair of guiding plates including an inner guiding plate positioned at a center side of the circular arc shape;

a transportation path which is formed between the pair of guiding plates and transports the recording medium to which the liquid has adhered toward a downstream side in the transportation direction;

a fan blowing unit which feeds air towards the transportation path; and a blowing port which is provided on the inner guiding plate and through which the air fed from the fan blowing unit is blown out;

wherein the fan blowing unit is provided in a space region which is formed at the center side of the circular arc shape of the inner guiding plate;

wherein a plurality of the blowing ports is provided in a direction along the transportation direction, and a ratio of an opening area of the blowing port positioned at the downstream side in the transportation direction with respect to an area of a wall surface of the inner guiding plate at the transportation path side is smaller than that of the blowing port positioned at the upstream side in the transportation direction.

2. The liquid ejecting apparatus according to claim 1, wherein the blowing unit blows out warm air through the blowing port by which drying of the liquid adhered to the recording medium is accelerated.

3. A liquid ejecting apparatus by which liquid is adhered to a recording medium comprising:

a liquid ejecting head which ejects liquid onto the recording medium;

a pair of guiding plates formed into a substantially circular arc shape, the pair of guiding plates including an inner guiding plate positioned at a center side of the circular arc shape;

a transportation path which is formed between the pair of guiding plates and transports the recording medium to which the liquid has adhered toward a downstream side in the transportation direction;

a blowing unit which feeds air into the transportation path; and a blowing port which is provided on the inner guiding plate and through which the air fed from the blowing unit is blown out, wherein a plurality of the blowing ports is provided in a direction along the transportation direction, a blowing-out direction of wind which is blown out through an uppermost-stream blowing port provided at the uppermost-stream side in the transportation direction is perpendicular to a tangent line direction of a wall surface of the inner guiding plate at the transportation path side, and a blow-out direction of the air which is blown out through each of downstream blowing ports provided at the downstream side with respect to the uppermost-stream blowing port in the transportation direction gradually increases in inclination from the vertical direction to a tangent line direction of the wall surface of the transportation path side of the inner guiding plate as a blowing port goes toward the downstream side.

4. The liquid ejecting apparatus according to claim 1, wherein the blowing unit includes a plurality of flow paths in order to feed different winds to an upstream side region and a downstream side region in the transportation direction on the transportation path.

5. The liquid ejecting apparatus according to claim 1, wherein the recording medium is transported such that a surface to which liquid has adhered faces the inner guiding plate side when the recording medium passes through the transportation path.

* * * * *